US006065826A

United States Patent [19]

Robinson et al.

[11] Patent Number: 6,065,826

[45] Date of Patent: May 23, 2000

[54] MODULAR PRINT CARTRIDGE RECEPTACLE FOR USE IN INKJET PRINTING SYSTEMS

[75] Inventors: Andrew R. Robinson; David S. Hunt, both of San Diego; Robert W. Beauchamp, Carlsbad; Michael J. Klausbruckner, San Diego; Mark A. Hay, Poway; Jayson L. Monroe, San Diego, all of Calif.

[73] Assignee: Hewlett-Packard Company, Palo Alto, Calif.

[21] Appl. No.: 09/167,392

[22] Filed: Oct. 6, 1998

[51] Int. Cl.[7] ..... B41J 2/01

[52] U.S. Cl. ..... 347/49; 347/37

[58] Field of Search ..... 347/49, 37, 38, 347/39

[56] References Cited

U.S. PATENT DOCUMENTS

| | | | |
|---|---|---|---|
| 4,811,035 | 3/1989 | Huliba et al. | 347/89 |
| 4,940,998 | 7/1990 | Asakawa | 346/140 R |
| 5,148,194 | 9/1992 | Asai et al. | 400/175 |
| 5,359,357 | 10/1994 | Takagi et al. | 347/49 |
| 5,372,512 | 12/1994 | Wilson et al. | 439/67 |
| 5,376,958 | 12/1994 | Richtsmeier et al. | 347/40 |
| 5,488,397 | 1/1996 | Nguyen et al. | 347/40 |
| 5,684,518 | 11/1997 | Nobel et al. | 347/50 |

FOREIGN PATENT DOCUMENTS 5-338135 12/1993 Japan .

8-174959 7/1996 Japan .

*Primary Examiner*—John S. Hilten
*Assistant Examiner*—Daniel J. Colilla
*Attorney, Agent, or Firm*—Dennis G. Stenstrom

[57] ABSTRACT

Disclosed is a modular print cartridge receptacle including a housing for removably receiving and supporting a single print cartridge; a locking mechanism on the housing for locking the print cartridge in the housing; and alignment surfaces on the housing for aligning and interlocking the housing with a second housing, the housing being used separately or in conjunction with a second housing. Also disclosed is a modular print cartridge receptacle including a housing for removably receiving and supporting a single print cartridge; a locking mechanism on the housing for locking the print cartridge in the housing; and a print cartridge driver circuit mounted on the housing and electrically connected with electrical interconnects on the housing for receiving signals from a printer and also electrically interconnected with electrodes on the housing for transmitting signals to the print cartridge when the print cartridge is installed in the housing, the housing being used separately or in conjunction with a second housing. The disclosed is a modular print cartridge receptacle for providing a flexible modular printing system which allows for flexibility in the design of printers for particular or unique applications. The invention allows for multiple modular print cartridge receptacles to be assembled together to quickly produce a functional specialized printing system.

33 Claims, 11 Drawing Sheets

MODULAR PRINT CARTRIDGE RECEPTACLE FOR USE IN INKJET PRINTING SYSTEMS

CROSS-REFERENCE TO RELATED APPLICATIONS

This application is related to U.S. patent application Ser. No. 09/167,394, filed concurrently herewith, entitled "Inkjet Printing Systems Using a Modular Print Cartridge Assembly" which is herein incorporated by reference.

FIELD OF THE INVENTION

This invention relates to inkjet printers and, more particularly, to a modular print cartridge receptacle.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* (Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)), incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. Properly sequencing the operation of each nozzle causes either to eject ink or to refrain from ejecting ink according to the output of the controlling microprocessor to cause characters or images to be printed upon the paper as the printhead moves past the paper or the paper moves past the printhead.

Color inkjet hardcopy devices commonly employ a plurality of print cartridges, usually two to four, mounted in the printer carriage to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

For many applications, such as personal computer printers and fax machines, the ink reservoir has been incorporated into the pen body such that when the pen runs out of ink, the entire pen, including the printhead, is replaced.

However, for other hardcopy high volume printing applications, such as large format plotting of engineering drawings, color posters and the like, there is a requirement for the use of much larger volumes of ink than can be contained within the replaceable pens. Therefore, various off-board ink reservoir systems have been developed recently which provide an external stationary ink supply connected to the scanning cartridge via a tube. The external ink supply is typically known as an "off-axis," "off-board," or "off-carriage" ink supply.

There is a trend to use inkjet printing in new specialized printing systems which are very different systems compared to desk-top printers and facsimile machines, or from large format plotters. These specialized printing systems include applications, such as postal printing, postal franking and bar code printing. Currently, there is no means to design a specialized printing system without a substantial engineering effort.

The disadvantages of prior solutions to specialized printing requirements is that the mechanical fixturing and electronics of current print cartridge receptacles are not flexible or modular enough to be used in applications that are not a continuation of the same product concept. For example, the carriage and electronics for a printer or facsimile machine cannot be easily leveraged to an application where specialized printing such as high volume postal franking or bar coding is required. Accordingly, with prior solutions there is no means to design a specialized printing system without a substantial engineering effort.

Accordingly, there is a need for a solution to the varied needs of specialty printing systems that provides flexibility and ease of adaptability, accurate and inexpensive methods of alignment of print cartridges and modular electrical connections between the print cartridge and the printer.

SUMMARY OF THE INVENTION

A first embodiment of present invention provides a modular print cartridge receptacle including a housing for removably receiving and supporting a single print cartridge; a locking mechanism on the housing for locking the print cartridge in the housing; and alignment surfaces on the housing for aligning and interlocking the housing with a second housing, the housing being used separately or in conjunction with a second housing. A second embodiment provides a modular print cartridge receptacle including a housing for removably receiving and supporting a single print cartridge; a locking mechanism on the housing for locking the print cartridge in the housing; and a print cartridge driver circuit mounted on the housing and electrically connected with electrical interconnects on the housing for receiving signals from a printer and also electrically interconnected with electrodes on the housing for transmitting signals to the print cartridge when the print cartridge is installed in the housing, the housing being used separately or in conjunction with a second housing.

The present invention provides a modular print cartridge receptacle for providing a flexible modular printing system which allows for flexibility in the design of printers for particular or unique applications. The invention allows for multiple modular print cartridge receptacles to be assembled together to quickly produce a functional specialized printing system.

BRIEF DESCRIPTION OF THE DRAWINGS

FIG. 1 comprising

DETAILED DESCRIPTION OF THE PREFERRED EMBODIMENTS

Figure 1A:
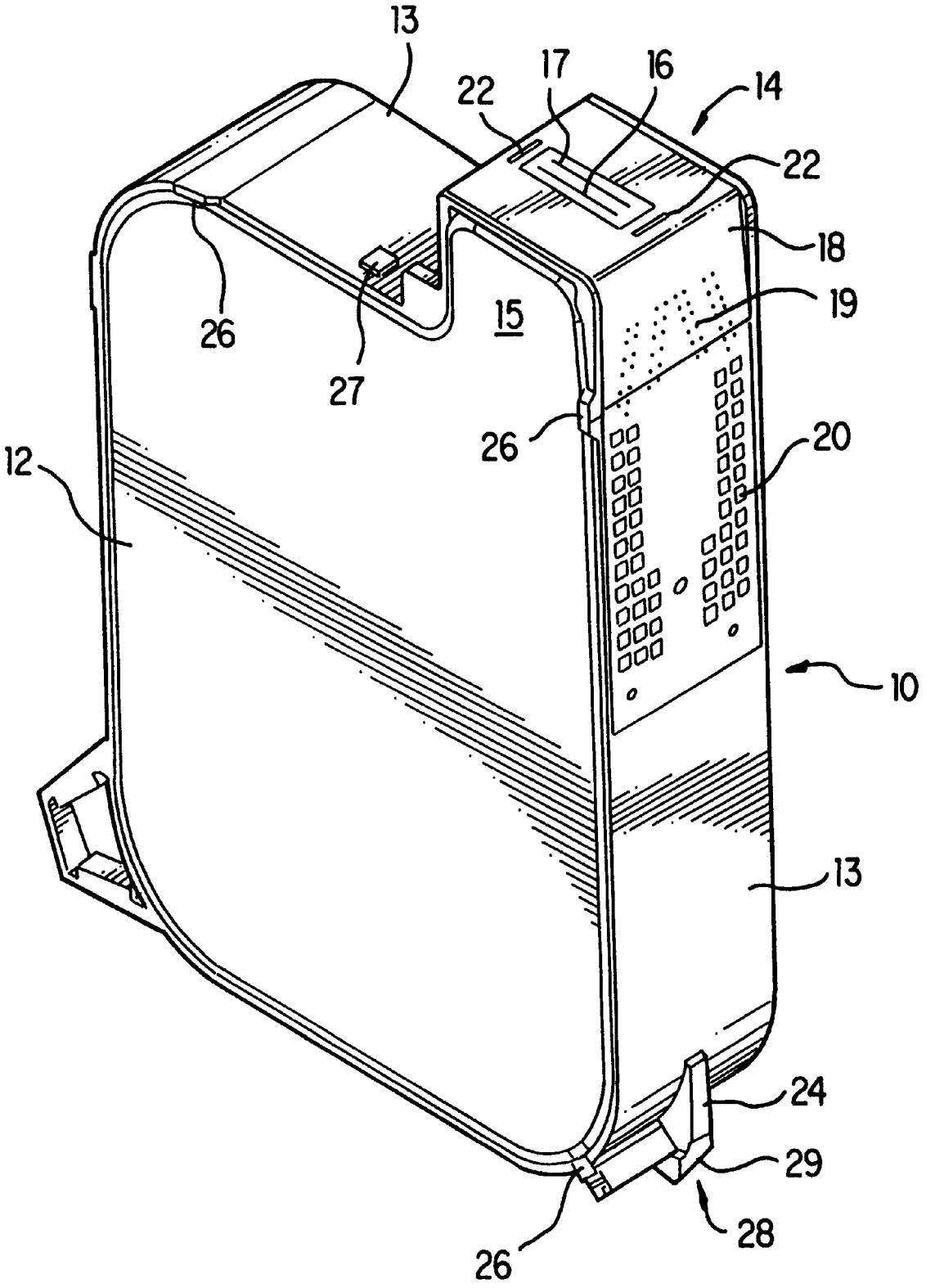
FIGS. 1A, 1B and 1C, are perspective views of a first inkjet print cartridge which can be used with the present invention as seen from the bottom rear, top rear and bottom front, respectively.
Figure 1B:
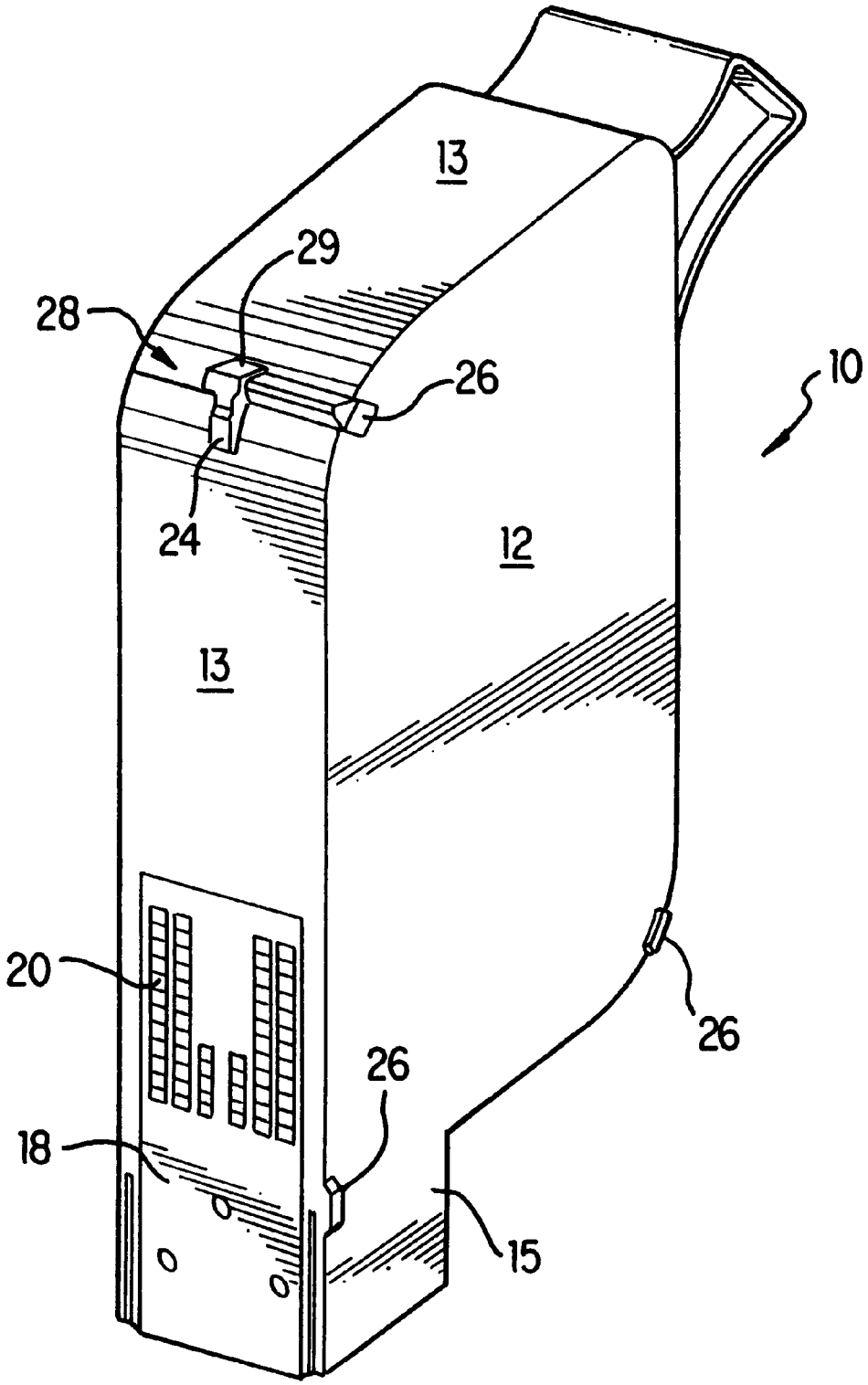
Figure 1C:
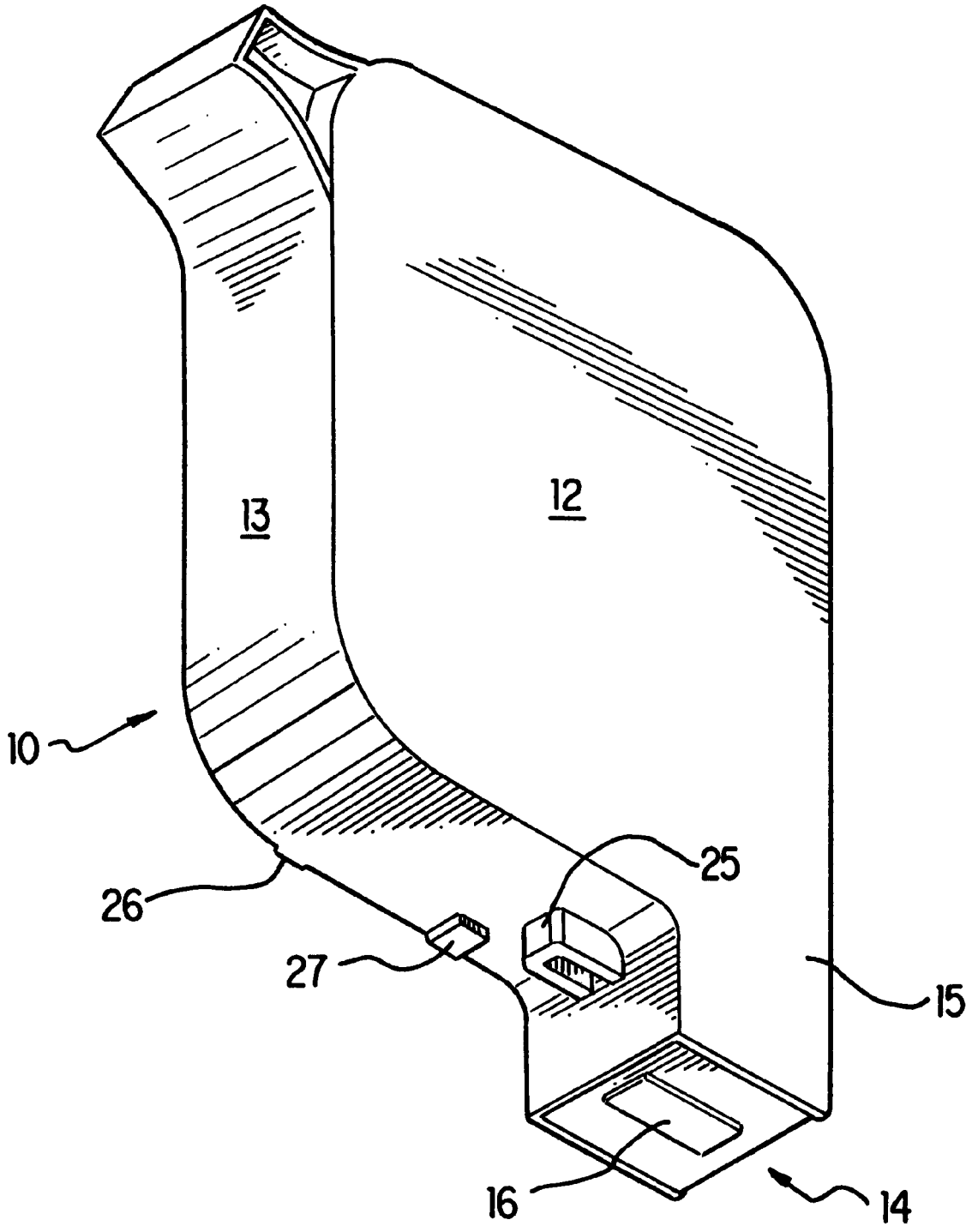

Referring to FIGS. 1A, 1B and 1C, shown is an inkjet print cartridge 10 which maybe used in the present invention. The inkjet print cartridge 10 includes two side walls 12 and a perimeter wall 13 and a printhead 14 affixed to the "snout" portion 15 of the perimeter wall 13. The printhead 14 includes a nozzle member 16 comprising two parallel columns of offset holes or orifices 17 formed in a flexible polymer flexible circuit 18 by, for example, laser ablation.

The flexible circuit 18 is bent over the back edge of the print cartridge "snout" and extends down the back perimeter wall of the snout. This flap portion of the flexible circuit 18 is needed for the routing of conductive traces 19 which are connected to substrate electrodes (not shown). The contact pads 20 are located on the flexible circuit 18 which is secured to the back of perimeter wall 13 and the conductive traces 19 are routed over the bend and are connected to the substrate electrodes.

Printhead 14 has affixed to the back of the flexible circuit 18 the silicon substrate containing a plurality of individually energizable thin film resistors. Each resistor is located generally behind a single orifice 17 and acts as a heater resistor for ejecting ink droplets when selectively energized by one or more pulses applied sequentially or simultaneously to one or more of the contact pads 20.

Windows 22 extend through the flexible circuit 18 and are used to facilitate bonding of the conductive traces 19 to the electrodes on the silicon substrate. The windows 22 are filled with an encapsulant after bonding the conductive traces 19 to the electrodes on the silicon substrate to protect any underlying portion of the traces and substrate.

The back surface of the flexible circuit 18 includes conductive traces 19 formed thereon using a conventional photolithographic etching and/or plating process. These conductive traces are terminated by contact pads 20 designed to interconnect with a modular print cartridge receptacle described below. The print cartridge 10 is designed to so that the contact pads 20, on the front surface of the flexible circuit 1 8, contact electrodes when the print cartridge is installed in a modular print cartridge receptacle.

The print cartridge 10 also includes datums for accurately aligning the print cartridge and the nozzle member 16 in the modular print cartridge receptacle of the present invention discussed below. The print cartridge 10 is provided with three datum surfaces 26 located on the perimeter of a sidewall of print cartridge 10 and sufficiently spaced apart from each other to provide accurate and stable alignment. The print cartridge is also provided with a forwardly facing fourth datum surface 25 located on the front lower portion of the snout and with a downwardly facing fifth datum surface 27 on the perimeter wall of the print cartridge adjacent the fourth datum surface, so as to establish a pivot axis above and in front of the snout, and with a rearwardly facing sixth datum surface 24 on the upper end of the print cartridge perimeter wall 13. the fifth datum surface 25 is used to determine the spacing of the nozzle to the print medium and the sixth datum surface is used to determine angular orientation of the print cartridge about a pivot point.

Alignment between two or more nozzle plates affixed to print cartridges installed in a modular print cartridge receptacle is achieved by machining datum projections 24–27 on each print cartridge after its nozzle plate 16 has been permanently secured to the print cartridge. The machined datum projections 24–27 on the print cartridge contact mating surfaces on a modular print cartridge receptacle described below when print cartridge 10 is installed in the modular print cartridge receptacle. The datums affect the position of the cartridge 10 , and hence the nozzle plate 16, within the modular print cartridge receptacle. Print cartridge 10 also has a latch engaging portion 28 having an angled surface 29 between the horizontal and vertical directions for engaging with a latching mechanism on the modular print cartridge receptacle to be described below.

For further details regarding the datums see U.S. Pat. No. 5,646,665 entitled "Side Biased Datum Scheme for Inkjet Cartridge and Carriage;" U.S. Pat. No. 4,907,018 entitled "Printhead-carriage Alignment and Electrical Interconnect Lock-inmechanism" U.S. Pat. No. 5,617,128 entitled "Alignment of Multiple Nozzle Members in a Printer;" and U.S. Pat. No. 5,408,746 entitled "Datum Formation for Improved Alignment of Multiple Nozzle Members in a Printer" which are herein incorporated by reference.

While print cartridge 10 is shown in FIG. 1 has an integral ink supply, print cartridge 10 is readily modified to receive ink from an off-axis ink supply. See, U.S. Pat. No. 5,675,367 entitled "Inkjet Print Cartridge Having Handle Which Incorporates an Ink Fill Port;" Wu, et al., U.S. patent application Ser. No. 09/045,151, filed Mar. 19, 1998, entitled "Alignment Coupling Device for Manually Connecting an Ink Supply to an Inkjet Print Cartridge" and Wu, et al., U.S. patent application Ser. No. 09/045,150, filed Mar. 19, 1998, entitled "Ink Replenishment System with an Open-valve Printhead Fill Port Continuously Connected to an Ink Supply" which are herein incorporated by reference.

Figure 2:
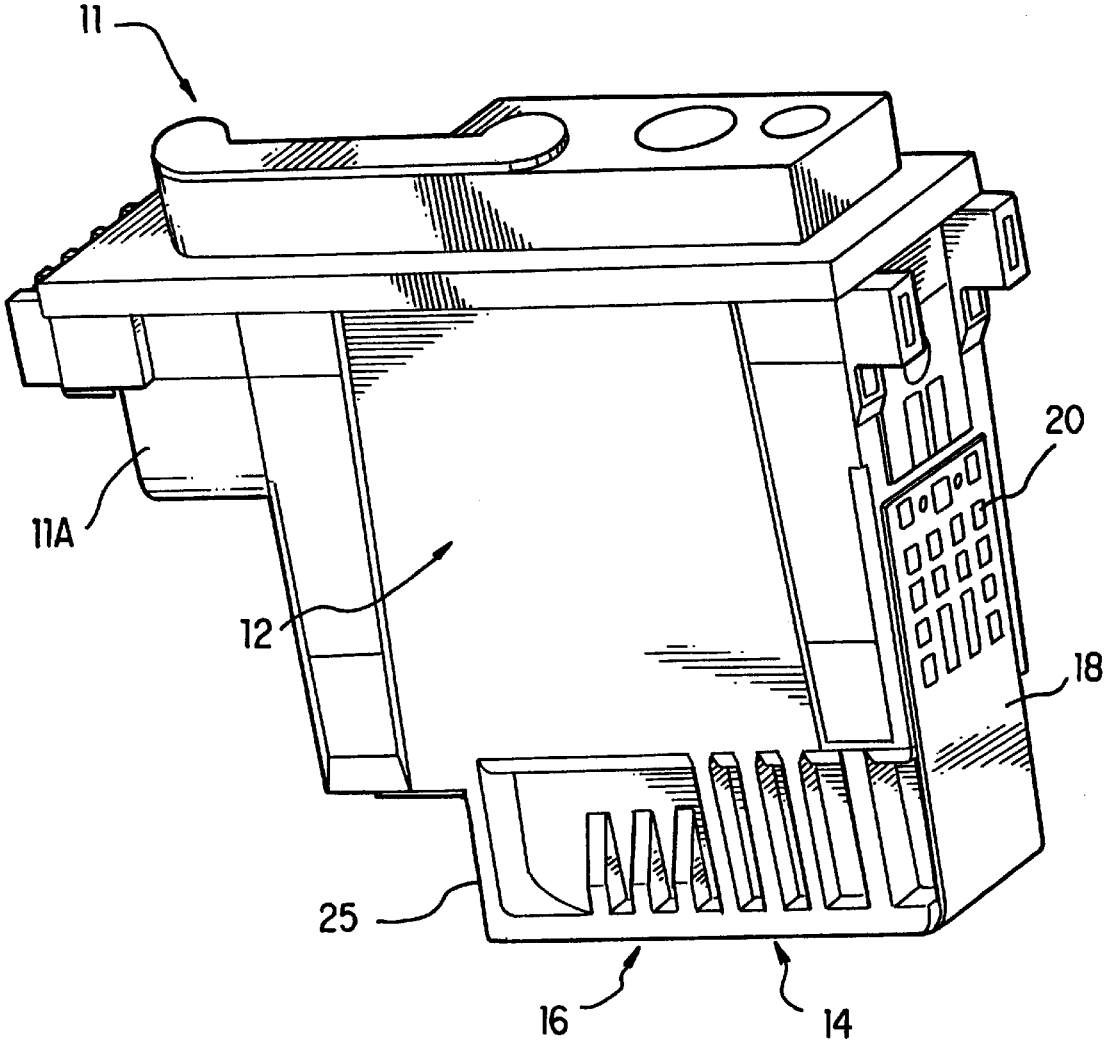
FIG. 2 is a perspective view of a second inkjet print cartridge which can be used with the present invention.

FIG. 2 is a perspective view of another print cartridge 11 using an off-axis ink supply. A shroud 11A surrounds an inlet needle and helps align a septum (not shown) on the printer with the print cartridge inlet needle when installing modular print cartridge receptacle 30 in a printer. The septum is in fluidic communication with an off-axis ink supply. Accordingly, when the inlet needle is inserted into the septum, print cartridge 11 is in fluid communication with an off-axis ink supply. A regulator valve (not shown) within print cartridge 11 regulates pressure by opening and closing an inlet hole to an internal ink reservoir 12 of print cartridge 11. For a description of the design and operation of the regulator see U.S. patent application Ser. No. 08/706,121, filed Aug. 30, 1996, entitled "Inkjet Printing System with Off-Axis Ink Supply Having Ink Path Which Does Not Extend above Print Cartridge," which is herein incorporated by reference. The other functional aspects of print cartridge 11 are the same as described for print cartridge 10 above.

A demultiplexer (not shown) may be formed on the substrate for demultiplexing the incoming multiplexed signals and distributing the address and primitive signals to the heater resistors. The demultiplexer demultiplexes the incoming electrical signals into signals to be applied to the heater resistors to selectively energize the various heater resistors to eject droplets of ink from nozzles 17 on a receiving media in the print zone. The demultiplexer enables the use of fewer contact pads 20 than heater resistors. Further details regarding multiplexing are provided in U.S. Pat. No. 5,541,269, issued Jul. 30, 1996, entitled "Printhead with Reduced Interconnections to a Printer," which is herein incorporated by reference.

Preferably, an integrated circuit logic using CMOS technology can be placed on the substrate in place of the demultiplexer in order to decode more complex incoming data signals than just multiplexed address signals and primitive signals, thus further reducing the number of contact pads 20 required. The incoming data signals are decoded by the integrated logic circuits on the printhead into address line and primitive firing signals. Performing this operation in the integrated logic circuits on the printhead increases the signal processing speed and the firing frequency of the printhead.

Figure 3:
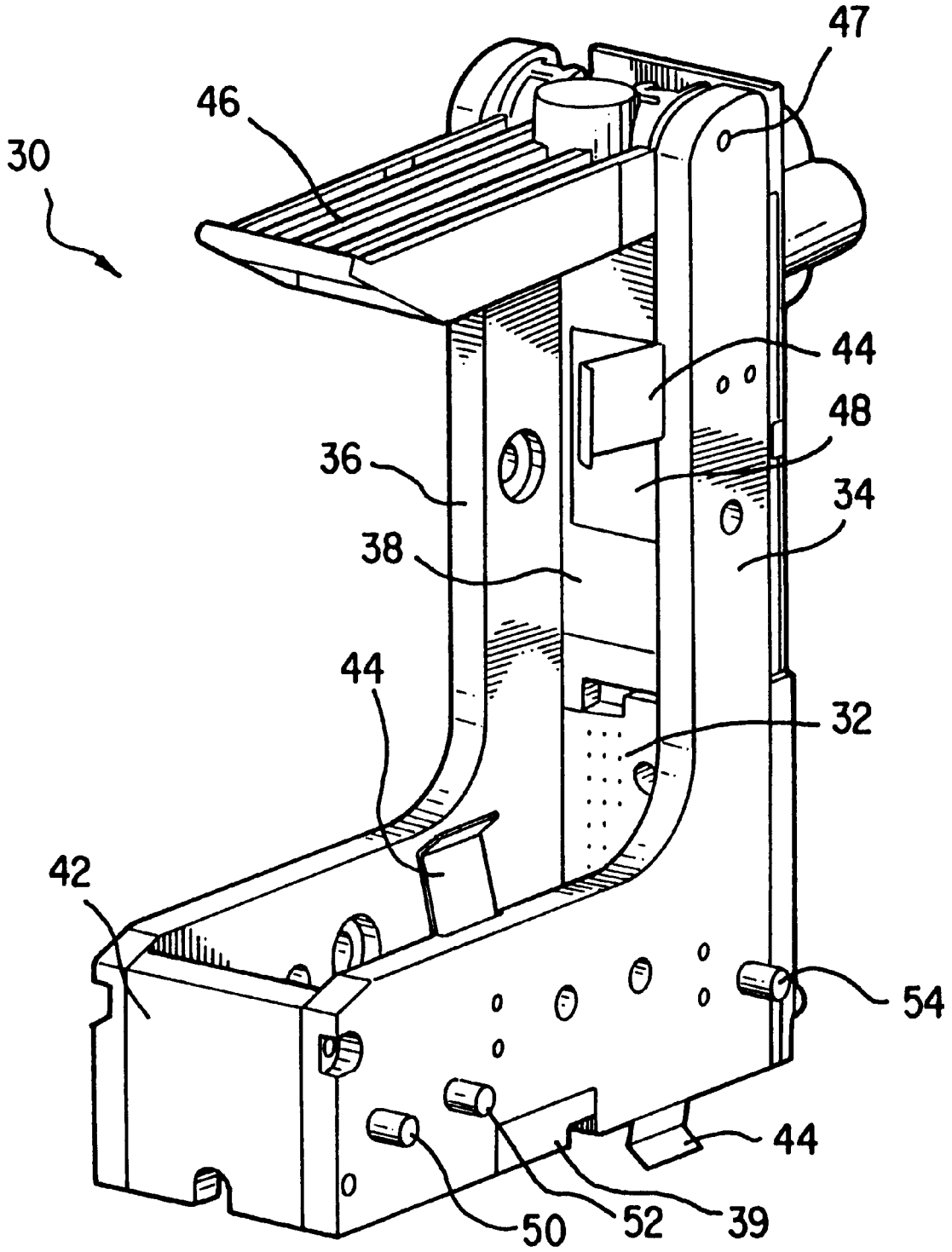
FIG. 3 is a perspective front right view of a singular modular print cartridge receptacle of the present invention.
Figure 4:
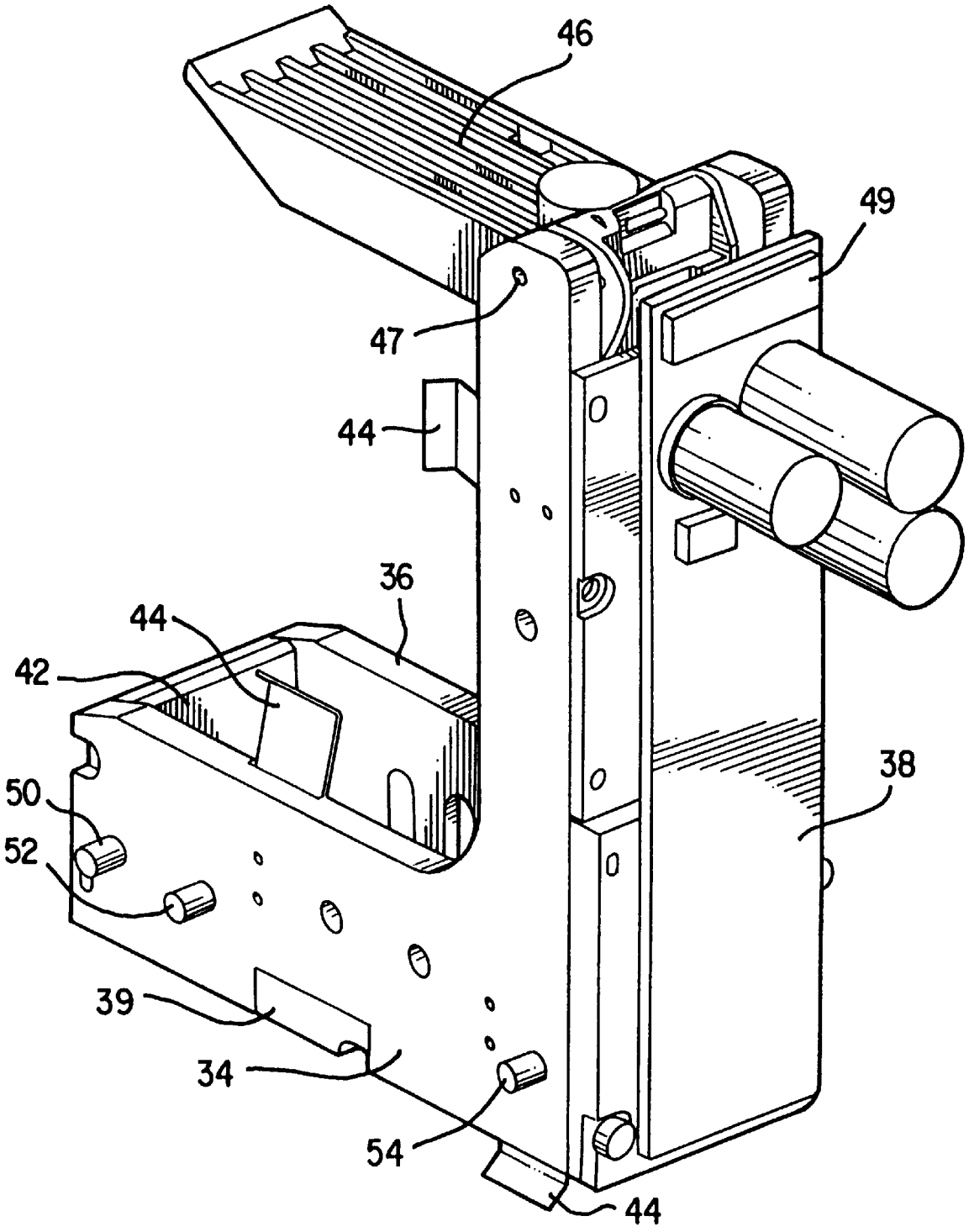
FIG. 4 is a perspective back right view of a singular modular print cartridge receptacle of the present invention.
Figure 5:
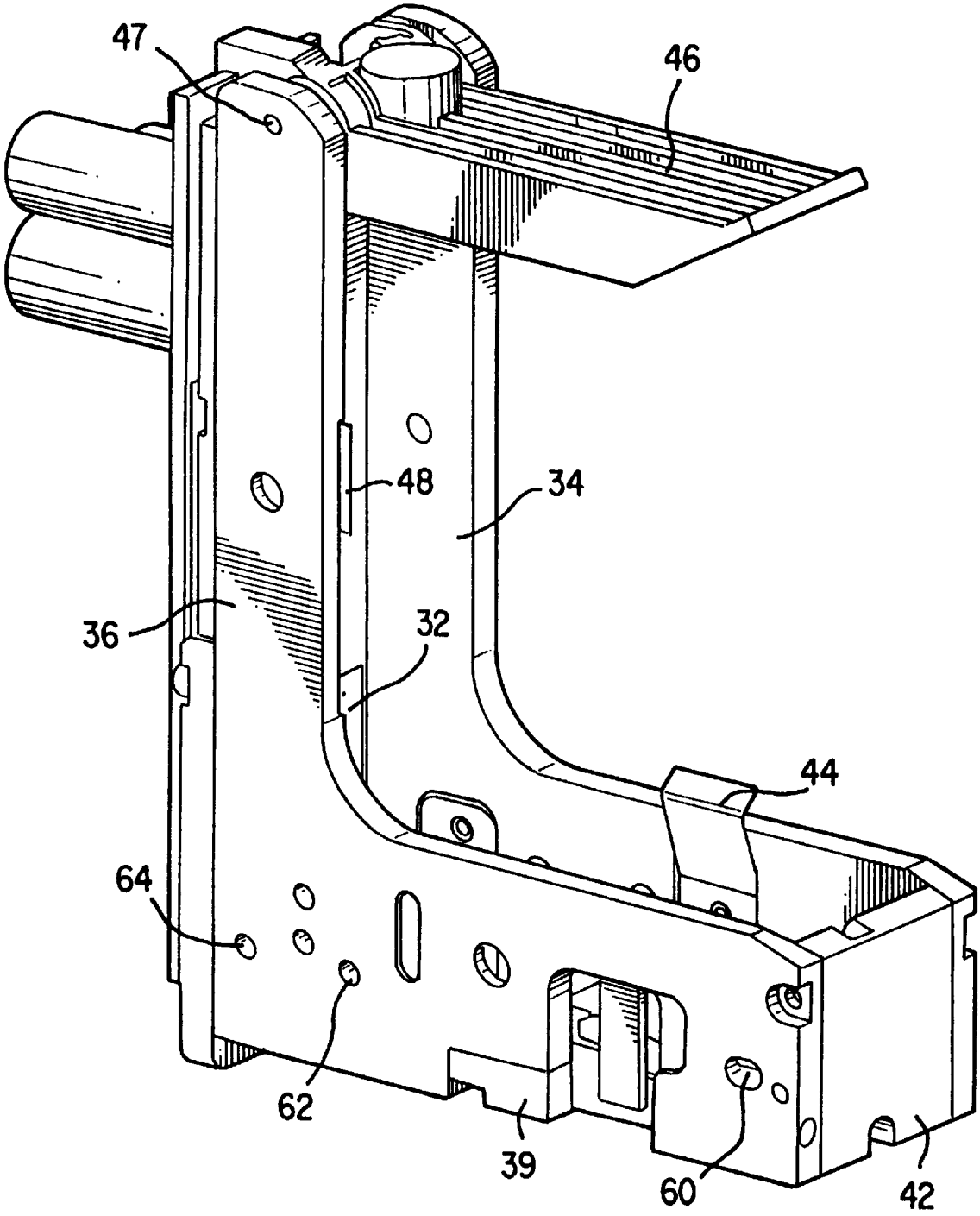
FIG. 5 is a perspective front left view of a singular modular print cartridge receptacle of the present invention.

While the following discussion and figures relate to the print cartridge shown in FIG. 1, one will readily recognize that the following discussion is equally applicable to the print cartridge of FIG. 2. FIGS. 3, 4 and 5 are perspective front and rear views of the single modular print cartridge receptacle 30 of the present invention.

The modular print cartridge receptacle 30 includes a right sidewall 34, a left sidewall 36 and a back wall 38 rigidly attached to sidewalls 34,36. Back wall 38 contains the electrical connections, or electrodes 32, a print cartridge driver circuit, or print ASIC 48, and electrical pin connectors 49 for electrical connection to a printer controller. Additional details of the front and back, or outside and inside of back wall 38 is described below in reference to FIG. 6. The modular print cartridge receptacle 30 also includes a partial bottom 39 attached to a portion of right sidewall 34 and left sidewall 36 to maintain rigidity of sidewalls 34, 36 and a datum reference surface. The bottom has an opening for snout 15 of print cartridge 10 and has a datum mating surface for engaging datum 27 on print cartridge 10 when print cartridge 10 is installed in the modular receptacle 30, thereby providing precise printhead to print media spacing. Optionally, modular receptacle 30 may also have a front wall 42 for providing further rigidity of the modular receptacle.

Figure 6A:
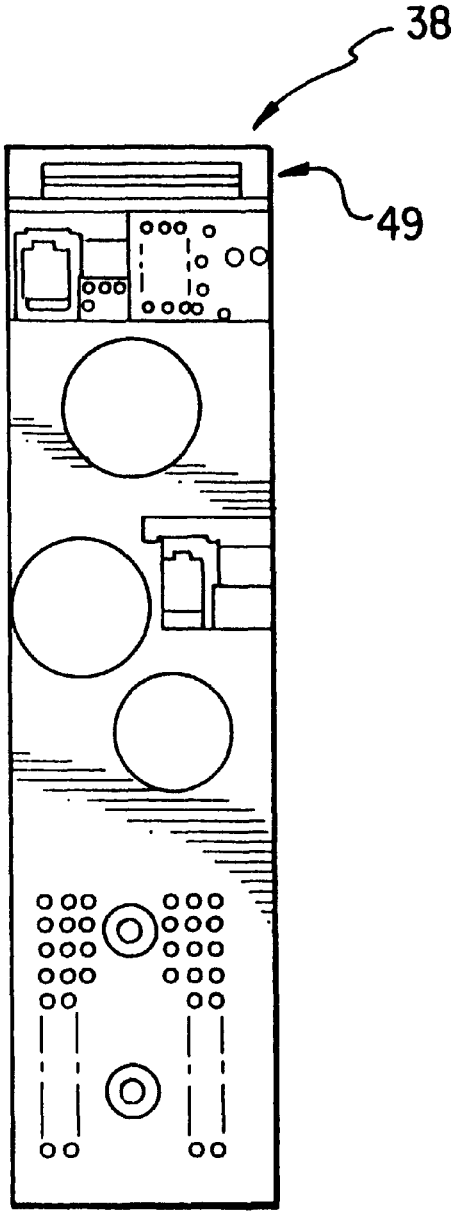
FIG. 6 is a view of the front and back walls of the modular print cartridge receptacle removed from the modular print cartridge receptacle.
Figure 6B:
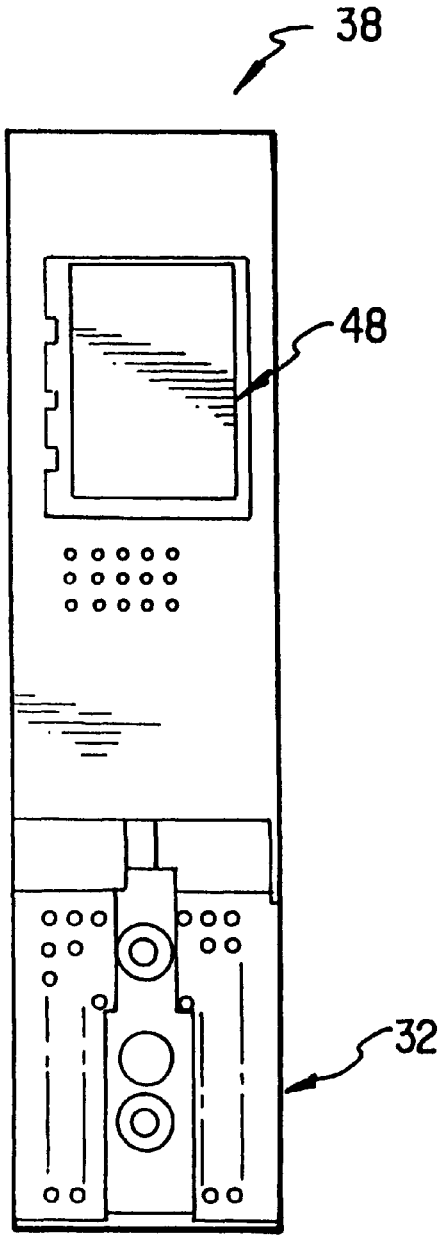

Referring to FIG. 6(*b*), back wall 38 has electrodes 32 mounted on the inside wall of back wall 38. The modular print cartridge receptacle 30 is designed so that when print cartridge 10 is installed in modular print cartridge receptacle 30, the contact pads 20, on the flexible circuit 18 of the print cartridge, align with and make contact with electrodes 32 on modular print cartridge receptacle 30 when the print cartridge 10 is installed in the modular print cartridge receptacle. The electrodes provide externally generated energization signals to the print cartridge 10. Preferably, the electrodes 32 on modular print cartridge receptacle 30 are resiliently biased toward the contact pads 20 on print cartridge 10 to ensure a reliable contact. Such electrodes are found in U.S. Pat. Nos. 5,608,434, 5,461,482, 5,372,512 and 5,684,518 all assigned to the present assignee and incorporated herein by reference.

As shown in FIG. 6(*b*), the modular print cartridge receptacle 30, also contains a print ASIC, or integrated circuit, dedicated to and mounted on the modular print cartridge receptacle. While the print ASIC may be mounted anywhere on the modular print cartridge receptacle, preferably, the print ASIC is mounted on the back wall 38 ease of electrical connection. The print ASIC interprets signals from a printer controller and delivers control signals to the electrodes 32 which in turn provide control signals to the print cartridge 10. As shown in FIG. 6(*a*), the modular print cartridge receptacle 30 also contains electrical connectors 49 for connection to a printer preferably, the electrical connectors 49 are mounted on the back wall 38 for ease of electrical connection.

When using a printhead with a large number of nozzles and high resolution, correct alignment of all the nozzles so that the ink is correctly placed on the print media is extremely important. Dot alignment must be done in both the horizontal and vertical axes. This requires the nozzle plates on all the print cartridges be aligned precisely with respect to one another after being installed in the modular receptacle and after the modular receptacles are assembled together. In a preferred alignment method, alignment between two or more nozzle plates affixed to print cartridges installed in modular print cartridge receptacle 30 is achieved by machining the datum projections 24–27 on each print cartridge 10 after its nozzle plate has been permanently secured to the print cartridge. The machined datum projections on the print cartridge contact surfaces on the modular print cartridge receptacle when the print cartridge is installed in the modular print cartridge receptacle such that the dimensions of the datums affect the position of the cartridge, and hence the nozzle plate, within the modular print cartridge receptacle.

Modular print cartridge receptacle 30 has one or more leaf springs 44 attached to right sidewall 34 of modular print cartridge receptacle 30. The cantilevered leaf springs 44 provide a sideways force. The leaf spring 44 in its uncompressed condition does not lie flat against sidewall 34, but extends into the interior of modular print cartridge receptacle 30. Accordingly, leaf springs 44 provide a sideways right to left bias force on the print cartridge 10 toward datum mating surfaces on the interior of left sidewall 36 that align with and engage the three datum surfaces 26 on the print cartridge 10.

The print cartridge can be secured within the modular print cartridge receptacle 30 by a locking mechanism, such as a hinged latch 46 which pivots about axis 47. When lowered latch 46 presses down on the latch engaging portion 28 of print cartridge 10. The latch engaging portion 28 on print cartridge 10 has an angled surface 29 between the horizontal and vertical directions for engaging with latch mechanism 46 on the modular print cartridge receptacle 30. Angled surface 29 causes print cartridge 10 to be biased both downward and leftward so as to engage datums 26 with the mating surfaces on left sidewall 36 of modular receptacle 30. Alternatively, the locking mechanism may comprise a spring assembly which movably allows the print cartridge to be snapped into the modular print cartridge receptacle 30. For further details regarding other locking mechanisms see U.S. Pat. No. 5,646,665 entitled "Side Biased Datum Scheme for Inkjet Cartridge and Carriage."

The exterior of right sidewall 34 of modular receptacle 30 contains alignment projections 50, 52 and 54 and left sidewall 36 of modular receptacle 30 contains alignment openings 60, 62 and 64. Alignment projections 50, 52 and 54 and alignment openings 62 and 64 are round and alignment opening 60 is oval shaped. The alignment projections and alignment openings are shown as round or oval shaped, but any other suitable shape for the alignment projections and alignment openings may be used. Alignment projections 50, 52 and 54 and alignment openings 60, 62 and 64 are used for joining and aligning two or more modular receptacles 30 together as discussed below.

The modular print cartridge receptacles 30, in addition to providing mechanical alignment and electrical interconnection also provides other functionalities through the print driver ASIC located on the modular print cartridge receptacle. These functionalities include: (1) controlled and accurate pulse firing energy for the print cartridge, (2) electrical pulse driving, (3) automatic pulse warming, (4) ambient temperature measurement, (5) printhead temperature measurement, (6) ESD protection (7) detection of, and protection from, open circuit and shorts, and (7) other servicing functions normally used to support inkjet print cartridges. These integrated features of modular print cartridge receptacle 30 allow for the easy development of specialized printing systems without the need for a thorough knowledge of thermal inkjet technology. Accordingly, the specialized printing system must only perform the following functions: (1) set the print cartridge firing energy level (the print driver ASIC ensures accurate deliver of that energy level), (2) set the firing order of the print cartridge, (3) set the time when the print cartridge is fired by providing a logic timing signal along with which nozzles are to be fired, and (4) set the pulse width of the firing pulse.

For additional details regarding print cartridge control see U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor;" U.S. Pat. 5,428,376, entitled "Thermal Turn on Energy Test for an Inkjet Printer;" and U.S. Pat. No. 5,682,185 entitled "Energy Management Scheme for an Ink Jet Printer." The foregoing commonly assigned patents and patent applications are herein incorporated by reference.

Figure 7:
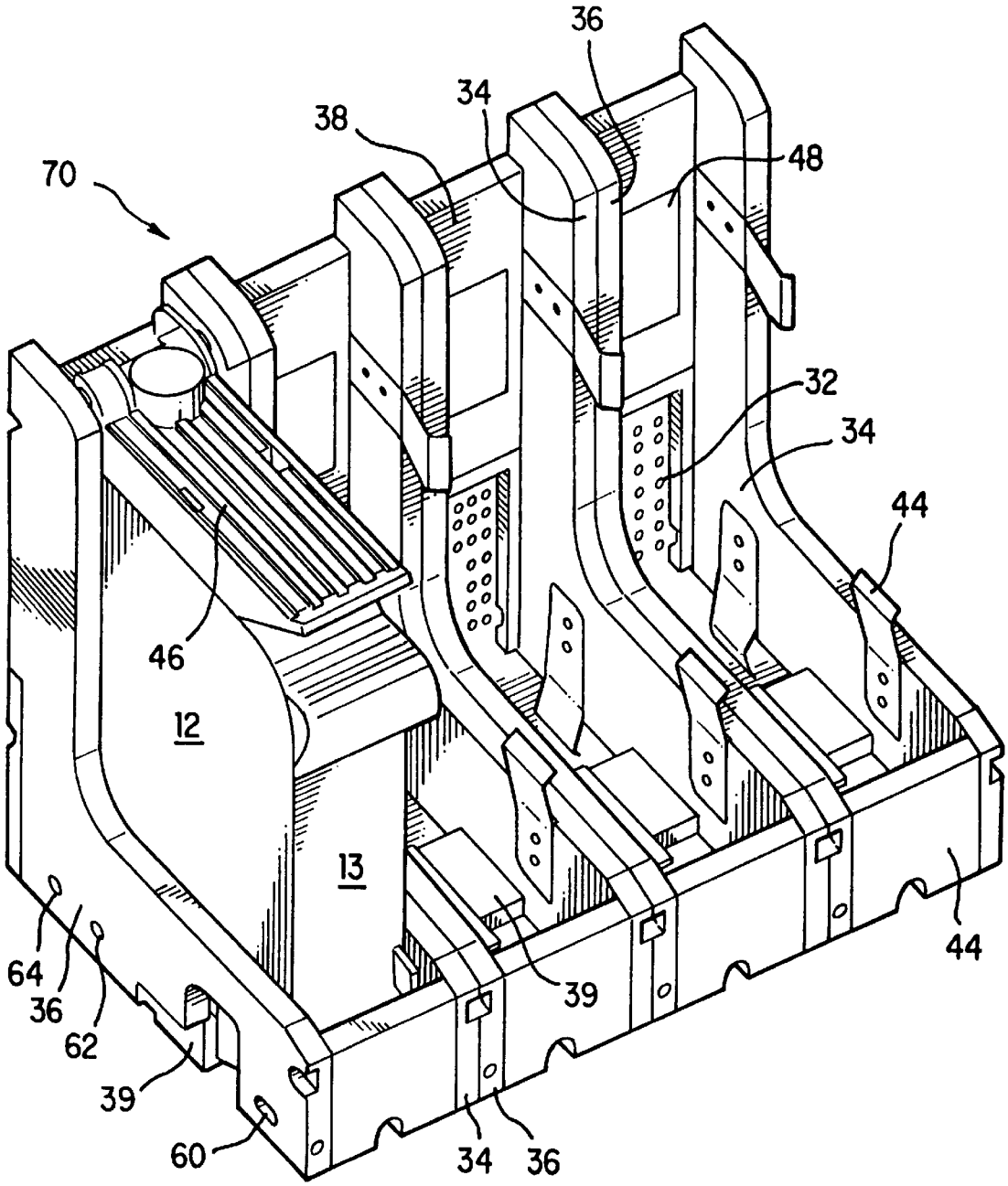
FIG. 7 is a perspective view of four modular print cartridge receptacles assembled in an aligned arrangement into a modular print cartridge receptacle assembly and showing one print cartridge installed in the modular assembly.

The modular print cartridge receptacles 30 may assembled in various configurations, only some of which are described below. One skilled in the art will readily see other possible combinations. First, modular print cartridge receptacles 30 may be assembled in an aligned arrangement into a modular print cartridge receptacle assembly 70. To assemble modular print cartridge receptacles assembly 70 in an aligned arrangement, alignment projections 50 and 54 are aligned and inserted into alignment openings 60 and 64, respectively, in the exterior left sidewall 36 of a second modular receptacle 30. FIG. 7 is a perspective view of four modular print cartridge receptacles 30 assembled in an aligned arrangement into a modular print cartridge receptacle assembly 70 and showing one print cartridge installed in the modular assembly.

Figure 8:
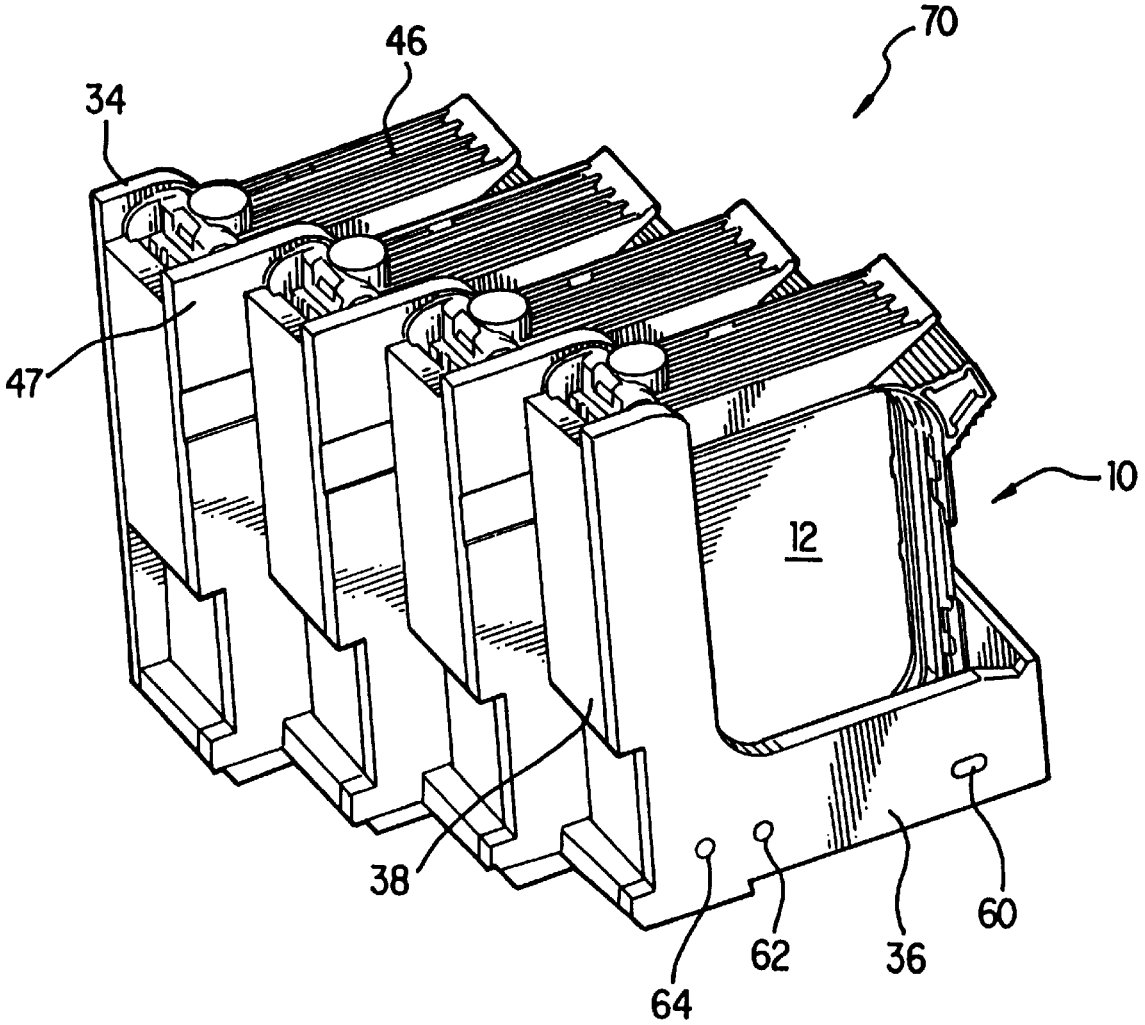
FIG. 8 is a perspective view of four modular print cartridge receptacles assembled in a staggered arrangement into a modular print cartridge receptacle assembly.

Second, modular print cartridge receptacles 30 may be assembled in a staggered arrangement into a modular print cartridge receptacle assembly 70. To assemble modular print cartridge receptacles assembly 70 in an aligned arrangement, alignment projections 52 and 54 are aligned and inserted into alignment openings 60 and 62, respectively, in the exterior left sidewall 36 of a second modular receptacle 30. FIG. 8 is a perspective view of four modular print cartridge receptacles assembled in a staggered arrangement into a modular print cartridge receptacle assembly. Precise alignment of the nozzle plates on different cartridges installed in different modular receptacles 30 is achieved by the precise location of alignment projections 50, 52 and 54 and alignment openings 60, 62 and 64.

The present invention makes the alignment between print cartridges simple and inexpensive since the print cartridge 10 machined datums 24–27 align print cartridge 10 precisely in modular receptacle 30 as described above. Accurate alignment between print cartridges located in adjacent modular receptacles 30 after assembly into a modular print cartridge assembly 70 is achieved by the precise alignment features of alignment projections 50, 52 and 54 and alignment openings 60, 62 and 64.

Figure 9A:
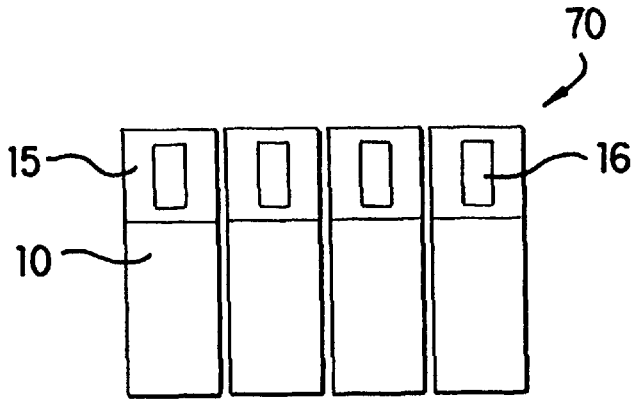
FIGS. 9(*a*), 9(*b*) and 9(*c*) are respective plan views of three different possible assembled configurations of modular print cartridge receptacles 30 and associated print cartridges as viewed upward from below the print cartridges to show the nozzle array 16.
Figure 9B:
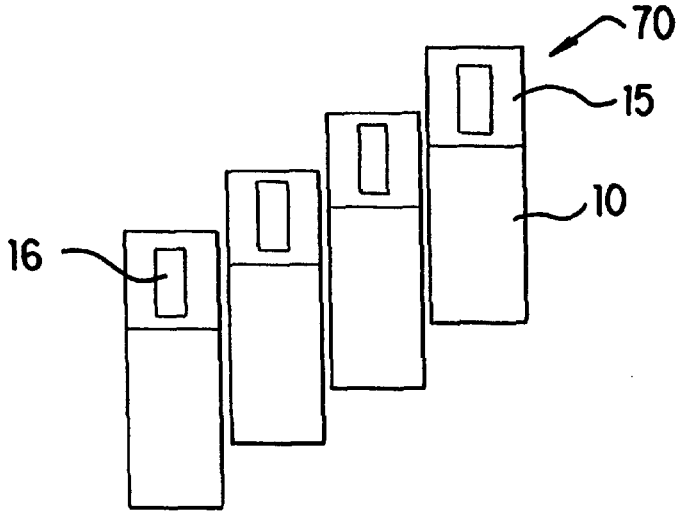
Figure 9C:
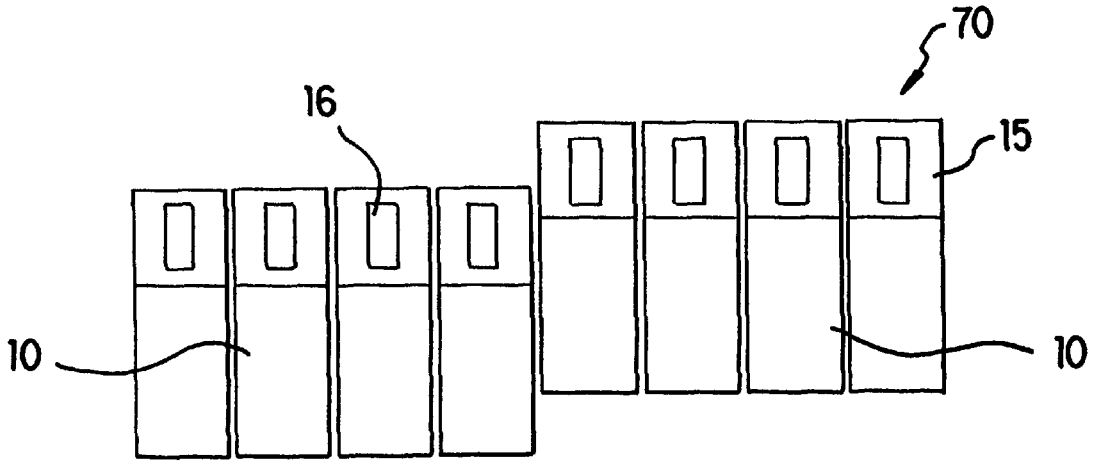

Modular print cartridge receptacles 30 may be assembled together in various configurations including combinations of both staggered and aligned modular print cartridge receptacles 30. Modular print cartridge receptacles 30 may be assembled together with either monochrome or multiple color ink print cartridges depending upon the printing system. FIG. 9 is a plan view of some different possible assembled configurations of modular print cartridge receptacles 30 and associated print cartridges as viewed upward from below the print cartridges to show the nozzle array 16. In an aligned arrangement, the each orifice, or nozzle, 17 in nozzle array 16 is aligned with the corresponding nozzle in the other print cartridges 10. In a staggered arrangement, the orifices 17 in nozzle array 16 are aligned such that the top nozzle in one print cartridge is aligned with the bottom nozzle in the adjacent print cartridge 10. Alternatively, in a staggered arrangement, the orifices 17 in nozzle array 16 are overlapped such that the top nozzles in one print cartridge is aligned with a nozzle above the bottom nozzle in the adjacent print cartridge 10. In this case electronic alignment through selective on/off control of individual nozzles may also be utilized.

FIG. 9(*a*) shows four modular print cartridge receptacles 30 and associated print cartridges 10 assembled in a fully aligned arrangement into a modular print cartridge receptacle assembly 70. FIG. 9(*b*) shows four modular print cartridge receptacles 30 and associated print cartridges 10 assembled in a fully staggered arrangement into a modular print cartridge receptacle assembly 70 having a swath width essentially equal to four individual print cartridges. Obviously, any number of modular print cartridge receptacles 30 and associated print cartridges 10 could be assembled in a fully staggered arrangement to provide a desired print swath width. FIG. 9(*c*) shows eight modular print cartridge receptacles 30 and associated print cartridges 10 assembled into a combination aligned and staggered modular print cartridge receptacle assembly 70. Obviously, any number of modular print cartridge receptacles 30 and associated print cartridges 10 could be assembled as in FIG. 9(*c*) to provide a desired print swath width. The arrangements shown in FIG. 9 are merely illustrative of the many possible combinations of staggered, aligned and the number of modular print cartridge receptacles 30 assembled into a modular print cartridge receptacle assembly 70.

Accordingly, the present invention provides for variable width printing. When using a single print cartridge for monochrome printing, the width of printing is determined by the length of the nozzle portion of the print cartridge. The present invention provides for mounting multiple print cartridges 10 through the use of modular print cartridge receptacles 30 in order to easily provide variable width printing. As many print cartridges 10 and modular print cartridge receptacles 30 may be assembled into a modular print cartridge receptacle assembly 70 as is necessary to achieve the desired print width. Greater throughput is possible by using wider print widths across the print media.

As a result of these design options, the modular print cartridge receptacle offers a wide range of product implementations. For example, such modular print cartridge receptacles systems may be incorporated into an inkjet printer used in a large format printer, facsimile machine, copier or a combined facsimile/copier.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. A modular print cartridge receptacle usable separately or in conjunction with a second modular print cartridge receptacle, the print cartridge including an inkjet nozzle array, the modular print cartridge comprising:

a housing for removably receiving and supporting a single print cartridge in a position such that the nozzle array of the print cartridge is exposed for emitting droplets of ink to form an image on a print medium;

a locking mechanism on the housing for locking the print cartridge in the housing; and alignment surfaces on the housing for aligning and interlocking the housing with the second modular print cartridge receptacle.

2. The modular print cartridge receptacle of claim 1, wherein the locking mechanism includes a spring assembly which allows the print cartridge to be removably snapped into and secured in the modular print cartridge receptacle.

3. The modular print cartridge receptacle of claim 1, wherein the housing has datum reference surfaces, and further including a biasing mechanism for applying forces on the print cartridge when installed in the housing in order to firmly secure datums on the print cartridge with the datum reference surfaces on the housing.

4. The modular print cartridge receptacle of claim 3, wherein the biasing mechanism includes leaf springs.

5. The modular print cartridge receptacle of claim 1, further including electrical interconnects on the housing for receiving signals from a printer.

6. The modular print cartridge receptacle of claim 1, further including electrodes mounted on the housing for receiving signals from electrical interconnects on the housing and supplying the signals to the print cartridge, the electrodes positioned on the housing so that when the print cartridge is installed in the housing the electrodes align with and make electrical contact with electrical contacts on the print cartridge.

7. The modular print cartridge receptacle of claim 1, further including datum reference surfaces on the housing for engaging datums on the print cartridge, the datum reference surfaces and datums on the print cartridge aligning the print cartridge in proper position within the housing.

8. The modular print cartridge receptacle of claim 7, wherein the datum reference surfaces are positioned to align the print cartridge in two planes.

9. The modular print cartridge receptacle of claim 7, wherein the datums are positioned to align the print cartridge in three planes.

10. The modular print cartridge receptacle of claim 7, wherein the housing further includes a back wall and a bottom for supporting the single print cartridge.

11. The modular print cartridge receptacle of claim 10, wherein a datum reference surface is located on at least one of said first and second sidewalls of the housing.

12. The modular print cartridge receptacle of claim 10, wherein a datum reference surface is located on the bottom of the housing.

13. The modular print cartridge receptacle of claim 10, wherein a datum reference surface is located on the back wall of the housing.

14. A modular print cartridge receptacle usable separately or in conjunction with a second modular print cartridge receptacle, the print cartridge including an inkjet nozzle array, the modular print cartridge receptacle comprising:

a housing for removably receiving and supporting a single print cartridge in a position such that the nozzle array of the print cartridge is exposed for emitting droplets of ink to form an image on a print medium;

a locking mechanism on the housing for locking the print cartridge in the housing; and a print cartridge driver circuit mounted on the housing and electrically connected with electrical interconnects on the housing for receiving signals from a printer and also electrically interconnected with electrodes on the housing for transmitting signals to the print cartridge when the print cartridge is installed in the housing.

15. The modular print cartridge receptacle of claim 14, wherein the locking mechanism includes a spring assembly which movably allows the print cartridge to be removably snapped into and secured in the modular print cartridge receptacle.

16. The modular print cartridge receptacle of claim 14, wherein the locking mechanism is a hinged latch.

17. The modular print cartridge receptacle of claim 14, wherein the locking mechanism further includes a datum reference surface for engaging a datum on a latch engaging portion of the print cartridge when installed in the housing, thereby providing downward and horizontal forces on the print cartridge.

18. The modular print cartridge receptacle of claim 14, wherein the housing has datum reference surfaces, and further including a biasing mechanism for applying forces on the print cartridge when installed in the housing in order to firmly secure datums on the print cartridge with the datum reference surfaces on the housing.

19. The modular print cartridge receptacle of claim 18, wherein the biasing mechanism includes leaf springs.

20. The modular print cartridge receptacle of claim 14, further including electrodes mounted on the housing for receiving signals from the print cartridge driver circuit mounted on the housing and supplying signals to the print cartridge, the electrodes positioned on the housing so that when the print cartridge is installed in the housing the electrodes align with and make electrical contact with electrical contacts on the print cartridge.

21. The modular print cartridge receptacle of claim 14, further including datum reference surfaces on the housing for engaging datums on the print cartridge, the datum reference surfaces and datums on the print cartridge aligning the print cartridge in proper position within the housing.

22. The modular print cartridge receptacle of claim 21, wherein the datum reference surfaces are positioned to align the print cartridge in two planes.

23. The modular print cartridge receptacle of claim 21, wherein the datums are positioned to align the print cartridge in three planes.

24. The modular print cartridge receptacle of claim 21, wherein the housing includes opposing sidewalls, a back wall and a bottom for supporting the single print cartridge.

25. The modular print cartridge receptacle of claim 24, wherein a datum reference surface is located on at least one sidewall of the housing.

26. The modular print cartridge receptacle of claim 24, wherein a datum reference surface is located on the bottom of the housing.

27. The modular print cartridge receptacle of claim 24, wherein a datum reference surface is located on the back wall of the housing.

28. A modular print cartridge receptacle usable separately or in conjunction with a second modular print cartridge receptacle, the modular print cartridge receptacle comprising:

a housing for removably receiving and supporting a single print cartridge, the housing including first and second opposed sidewalls;

a locking mechanism on the housing for locking the print cartridge in the housing; and alignment surfaces on the housing for aligning and interlocking the housing with the second modular print cartridge receptacle, said alignment surfaces including protrusions on the first sidewall of the housing and alignment recesses on the second sidewall of the housing.

29. The modular print cartridge receptacle of claim 28, wherein the alignment protrusions are circular shaped and the alignment recesses are circular and elongated circular shaped.

30. A modular print cartridge receptacle usable separately or in conjunction with a second modular print cartridge receptacle, the modular print cartridge receptacle comprising:

a housing for removably receiving and supporting a single print cartridge, the housing including first and second opposed sidewalls;

a locking mechanism on the housing for locking the print cartridge in the housing, said locking mechanism comprising a hinged latch; and alignment surfaces on the housing for aligning and interlocking the housing with the second modular print cartridge receptacle.

31. The modular print cartridge receptacle of claim 30, wherein the locking mechanism further includes a datum reference surface for engaging a datum on a latch engaging portion of the print cartridge when installed in the housing, thereby providing downward and horizontal forces on the print cartridge.

32. A modular print cartridge receptacle usable separately or in conjunction with a second modular print cartridge receptacle, the modular print cartridge receptacle comprising:

a housing for removably receiving and supporting a single print cartridge, the housing including first and second opposed sidewalls;

alignment surfaces include protrusions on the first sidewall of the housing and alignment recesses on the second sidewall of the housing, the alignment protrusions and alignment recesses providing for aligning and interlocking the housing with the second modular print cartridge receptacle;

a locking mechanism on the housing for locking the print cartridge in the housing; and a print cartridge driver circuit mounted on the housing and electrically connected with electrical interconnects on the housing for receiving signals from a printer and also electrically interconnected with electrodes on the housing for transmitting signals to the print cartridge when the print cartridge is installed in the housing, the housing being used separately or in conjunction with a second housing.

33. The modular print cartridge receptacle of claim 32, wherein the alignment protrusions are circular shaped and the alignment recesses are circular and elongated circular shaped.

* * * * *